United States Patent [19]

Schmidt

[11] 3,988,796

[45] Nov. 2, 1976

[54] METHOD OF MAKING TOOTHED LOCK WASHERS

[75] Inventor: Rudolph Schmidt, Mountainside, N.J.

[73] Assignee: Triangle Tool Company, Union, N.J.

[22] Filed: Aug. 13, 1975

[21] Appl. No.: 604,101

[52] U.S. Cl. ..... 10/86 B

[51] Int. Cl.[2] ..... B21D 53/20

[58] Field of Search ..... 10/73, 86 B; 85/50 R; 151/35

[56] References Cited

UNITED STATES PATENTS

| | | | |
|---|---|---|---|
| 1,659,161 | 2/1928 | Richer | 10/86 B |
| 1,784,142 | 12/1930 | Hosking | 10/86 B |
| 2,188,310 | 1/1940 | Price | 10/86 B |
| 2,234,194 | 3/1941 | Poupitch | 10/86 B |
| 2,352,118 | 6/1944 | Poupitch | 10/86 B |

FOREIGN PATENTS OR APPLICATIONS

| | | | |
|---|---|---|---|
| 12,694 | 5/1933 | Australia | 10/73 |

*Primary Examiner*—C.W. Lanham
*Assistant Examiner*—E. M. Combs
*Attorney, Agent, or Firm*—Samuelson & Jacob

[57] ABSTRACT

A method of making toothed lock washers from sheet material wherein the lock washer bodies are blanked from the sheet material with adjacent outline configurations of the lock washers in close proximity within the sheet material, whereby the unused portions of sheet material between the outline configurations is minimized and sheet material is conserved.

5 Claims, 6 Drawing Figures

METHOD OF MAKING TOOTHED LOCK WASHERS

The present invention relates generally to the manufacture of toothed lock washers and pertains, more specifically, to a method by which such lock washers can be manufactured with increased economy.

Toothed lock washers of the variety which includes a generally annular body portion with locking teeth projecting radially from the body portion and being twisted relative thereto have enjoyed wide commercial acceptance. While the configuration of such lock washers would appear to be relatively simple, such simplicity is deceptive when considered in light of the rapid and efficient fabrication which is necessary to reduce the cost of manufacture to a competitive minimum while maintaining the quality necessary for the proper operation of such lock washers. One factor in determining the cost of manufacturing lock washers is the cost of the sheet material stock from which the washers are fabricated. While various arrangements have been proposed in past efforts to reduce the amount of scrap resulting from unused portions of the sheet material, recent increases in the cost of the appropriate sheet material have made such reductions in scrap even more desirable.

It is therefore an object of the invention to provide a method whereby toothed lock washers may be manufactured from sheet material stock with the minimum waste of stock.

Another object of the invention is to provide a method of making toothed lock washers which allows increased economy of manufacture through a reduction of scrap, with the toothed lock washers having a configuration which departs only slightly from that of the most common current commercially available lock washers.

Still another object of the invention is to provide a method of making toothed lock washers from sheet material wherein the lock washer bodies are blanked from the sheet material with adjacent outline configurations of the lock washers in close proximity within an integral web of sheet material of minimal area.

A further object of the invention is to provide a method which enables the economical manufacture of toothed lock washers with a reduced number of tools and procedures and which can be carried out in conventional machinery.

A still further object of the invention is to provide a method which enables more economical manufacture of toothed lock washers in large numbers of uniform high quality.

The above objects, as well as still further objects and advantages, are attained by the invention which may be described briefly as providing, in a method of making toothed lock washers from sheet material, each washer having a generally annular body portion including a center and a plurality of teeth projecting radially to an overall radius, the teeth being spaced circumferentially essentially equidistant from one another and twisted relative to the body portion to provide locking edges spaced axially from at least one surface of the portion, the circumferential width of the spaces between adjacent teeth being at least as great as the circumferential width of the teeth themselves, the steps of blanking, from the sheet, a plurality of washer bodies, each leaving in the sheet an outline configuration which includes a number of radially projecting portions spaced circumferentially essentially equidistant from one another and corresponding to the teeth, with the circumferential spaces between the radially projecting portions having a circumferential width corresponding to the circumferential width of the spaces between adjacent teeth, the number of radially projecting portions being an odd whole number multiple of three, simultaneous with, and as a result of the blanking, positioning the washer body outline configurations relative to one another in the sheet such that three adjacent washer body outline configurations are located with the centers of the outline configurations positioned essentially at the vertices of an equilateral triangle and are oriented relative to one another such that a radially projecting portion of one of the outline configurations is aligned with and extends into a circumferential space between adjacent projecting portions of another of the outline configurations generally along a side of the equilateral triangle with the length of each side of the equilateral triangle reduced to a minimum, whereby the outline configurations are in close proximity and the area of portions of the sheet between adjacent outline configurations is reduced to a minimum, and twisting the radially projecting portions of each blanked washer body to establish the locking edges.

The invention will be more fully understood, while still further objects and advantages thereof will be made apparent, in the following detailed description of an embodiment of the invention illustrated in the accompanying drawing, in which.

Figure 2:
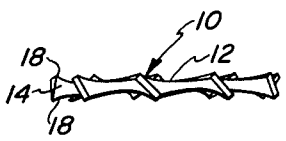
FIG. 2 is an elevational view of the toothed lock washer of FIG. 1.
Figure 1:
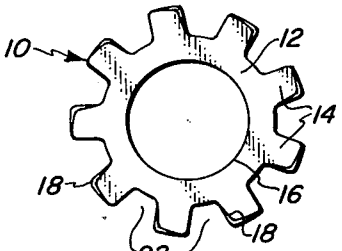
FIG. 1 is a plan view of a toothed lock washer made in accordance with the invention.

Referring now to the drawing, and especially to FIGS. 1 and 2 thereof, a toothed lock washer which has been manufactured in accordance with the invention is illustrated at 10 and is seen to have a generally circular configuration including a generally annular body portion 12 with a plurality of external locking teeth 14 projecting radially outwardly therefrom. A central aperture 16 passes through the body portion 12 for receiving a threaded fastener element in a now well-known manner. Teeth 14 are twisted relative to the body portion 12 so as to present upper and lower locking edges 18 along the teeth, which locking edges are spaced axially from the opposite surfaces of the body portion 12.

Figure 3:
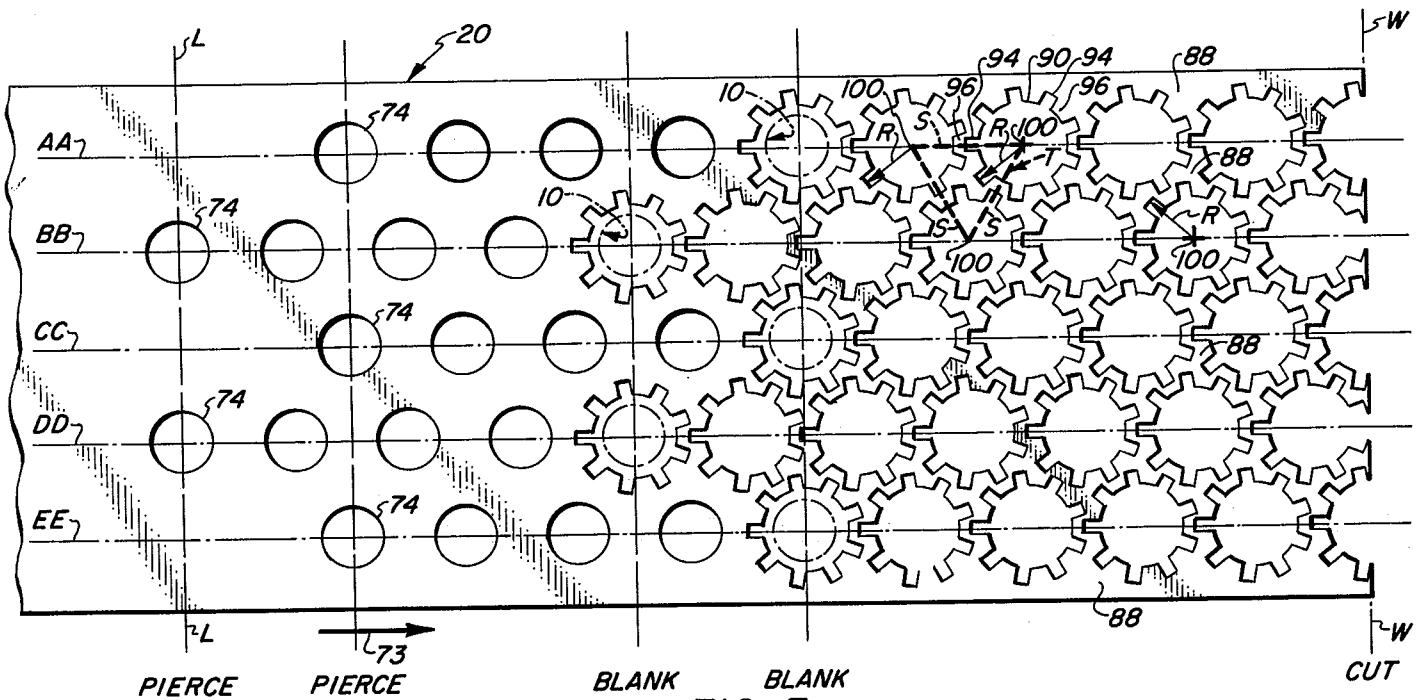
FIG. 3 is a plan view of an elongate strip of sheet material illustrating steps in the fabrication of the toothed lock washer of FIG. 1.
Figure 4:
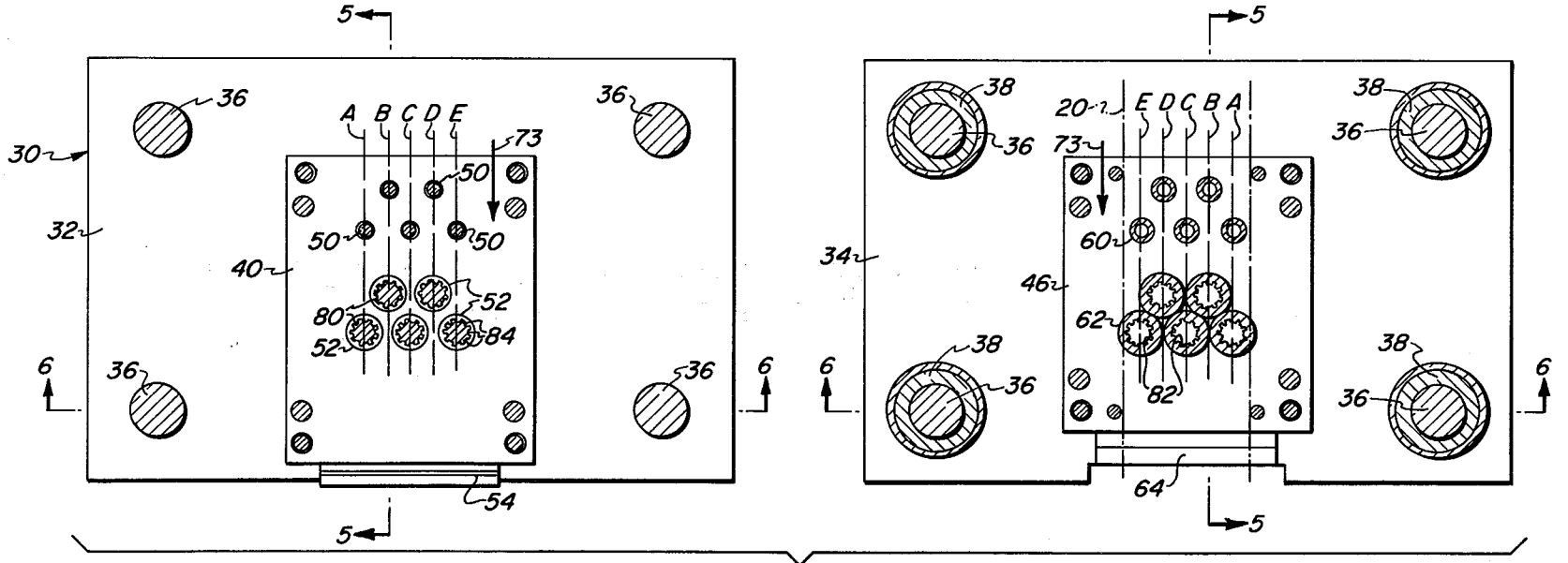
FIG. 4 is a plan view of apparatus for carrying out the manufacture of the lock washer.
Figure 6:
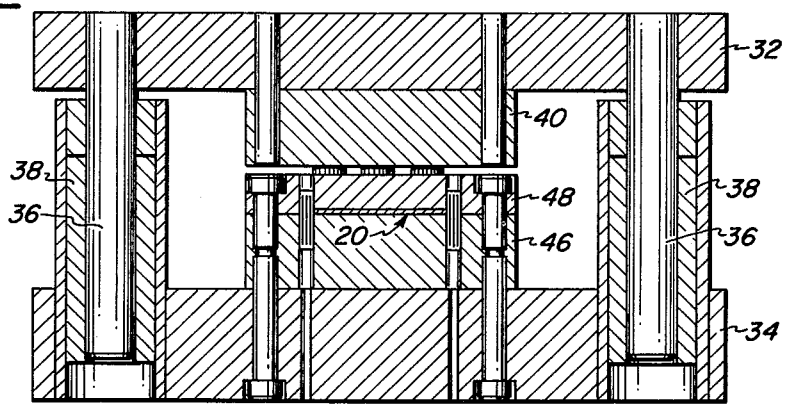
FIG. 6 is a cross-sectional view taken along lines 6-6 of FIG. 4.
Figure 5:
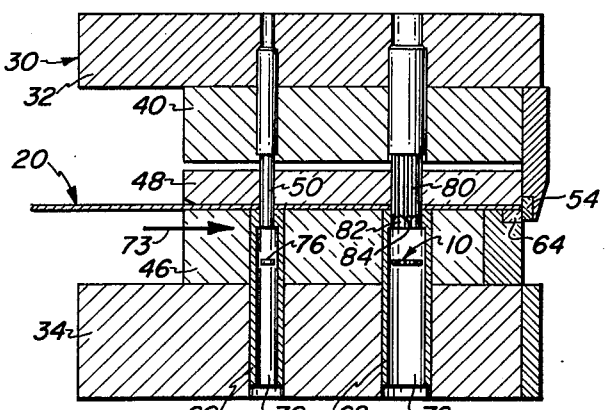
FIG. 5 is a cross-sectional view taken along lines 5—5 of FIG. 4.

Turning to the remaining figures, FIG. 3 shows a sheet of stock in the form of a longitudinally extending elongate strip 20 of sheet material from which a plurality of toothed lock washers have been fabricated. The method of manufacture is best described in connection with the apparatus illustrated in FIGS. 4 through 6, as well as the strip 20 shown in FIG. 3.

Strip 20 is advanced in predetermined increments through a die set 30 having an upper platen 32 and a lower platen 34. Upper and lower platens 32 and 34 are arranged for relative reciprocating motion by means of the cooperation of rods 36, fixed to upper platen 32, with sockets 38, fixed to lower platen 34. An upper tool carrier 40 is fixed to the upper platen for movement therewith. The upper platen 32 is viewed, in FIG. 4, from below so as to illustrate the various operating tools carried by the tool carrier while the lower platen 34 is viewed from above so as to show the various stationary tools which are fixed in a lower tool carrier 46 and are complementary to the reciprocating tools carried by the upper platen. A stripper plate 48 is carried by the lower platen 34 above the tool carrier 46. The movable tools carried by the upper platen are duplicated to provide five separate series of tools, each series being capable of producing a lock washer 10 in strip 20 as the strip progresses through the die set.

Each series of operating tools carried by the upper platen includes a piercing punch 50, a combination blanking and forming punch 52, and a cut-off blade 54, each fixed in the upper tool carrier 40 for reciprocating movement with the upper platen. Each of the tools of a particular series lie along a common longitudinal line. Thus, piercing punch 50 and forming punch 52 of a first series of tools lie along longitudinal line A, which corresponds to line AA extending longitudinally along strip 20, as seen in FIG. 3. Likewise, the remaining series of tools lie along lines B, C, D and E, corresponding to lines BB, CC, DD and EE along strip 20. Lower platen 34, which normally is stationary, likewise carries five individual series of tools in the lower tool carrier 46, each of which series is complementary to a like series in the upper, relatively movable platen. Thus, the tools of each series held in the lower tool carrier 46 of the lower platen include a punching die 60 for cooperating with the piercing punch 50, a blanking die 62 for cooperating with blanking and forming punch 52, and a stationary cut-off blade 64 for cooperating with reciprocating blade 54. The lower tool carrier and platen also include a first chute 70 below piercing punch 50 and a second chute 72 below blanking die 62.

Lock washers 10 are fabricated by the following procedure: Strip 20 is advanced in a longitudinal direction from left to right, as viewed in FIG. 3, in the direction of arrow 73, in predetermined increments so as to position any given longitudinal location along the strip, such as that indicated by lateral dashed line L in FIG. 3, between one of the complementary sets of tools in a particular series. The strip is first pierced by piercing punch 50 to establish an aperture 74 which will correspond to the central aperture 16 in the finished lock washer, the scrap 76 passing out of the apparatus through chute 70. The strip is then advanced so that the pierced location is positioned between the combination blanking and forming punch 52 and blanking die 62. The punch 52 is provided with ribs 80 and the blanking die has complementary grooves 82 so that upon reciprocation of the upper platen the strip is blanked to form a lock washer body with radially projecting portions coresponding to the teeth 14 of the finished lock washer 10. Punch 52 also is provided with angled end faces 84 at the lowermost ends of the ribs 80 so that upon blanking a lock washer body the radially projecting portions simultaneously are twisted through a desired angle to establish the locking edges 18 in teeth 14. Thus, a completed lock washer 10 is delivered through each chute 72, utilizing a minimum number of tools.

In order to make maximum use of the sheet material of strip 20, and thus conserve sheet stock, the relative location of the tools and the configuration of the lock washers are such that the area of the portions 88 of the strip between adjacent washer body outline configurations 90, left behind after blanking the washers from the strip, is held to a minimum. Thus, in lock washer 10, teeth 14 are spaced circumferentially essentially equidistant from one another around the perimeter of the generally annular body portion 12 and the circumferential width of each space 92 between teeth 14 is at least as great as the circumferential width of each tooth. By choosing the appropriate number of teeth 14 for each lock washer, adjacent outline configurations 90 in the strip 20 can be brought into close proximity and even can be nested; that is, the radially projecting portion 94 (corresponding to a tooth 14 of the washer) of one outline configuration 90 can be aligned with and even can be received within a circumferential space 96 (corresponding to space 92 of the washer) between portions 94 of an adjacent outline configuration such that the distance between the centers of the adjacent outline configurations is reduced to a minimum. Where projecting portions 94 actually extend into adjacent spaces 96, as illustrated in FIG. 3, the distance between the centers of the adjacent outline configurations is less than the sum of the overall radii of two adjacent outline configurations, whereby the area of the unused portions 88 of strip 20 is reduced to a minimum, while the unused portions remain in an integral web.

Referring to FIG. 3, as well as to FIG. 1, it will be seen that lock washer 10 is provided with nine teeth 14. Outline configurations 90 are located in strip 20 such that any three adjacent outline configurations 90 are located with their centers 100 positioned essentially at the vertices of an equilateral triangle T having sides S. Each side S is shorter than the sum of the overall radii R of any two of the adjacent three outline configurations 90 by virtue of the reception of a radially projecting portion 94 within a circumferential space 96 and the consequent nesting of the adjacent outline configurations. It has been found that by providing the lock washers with a number of teeth which is an odd whole number multiple of three, i.e., three, nine, 15, 21, 27, etc., the outline configurations 90 (which have the same number of radially projecting portions 94) can be placed with their centers at the vertices of an equilateral triangle and can be oriented so that they are in close proximity, and can even nest as set forth to reduce the amount of unused stock to a minimum, concomitant with maintaining the unused portions 88 in the form of an integral web for purposes to be explained below. The choice of the number of teeth for lock washers 10 enables the teeth to be spaced equidistant from one another, as in conventional, currently available toothed lock washers, while also enabling the orientation and location of the tools to attain close proximity and even nesting of the washer outline configurations 90 in the strip. Lock washer 10 is provided with nine teeth, a number which has been found to provide economy of manufacture as well as good performance characteristics. The integral web of minimal unused portions 88 of strip 20 is then cut into scrap at line W by the action of cutting blades 54 and 64.

In the continuous manufacture of lock washers 10, strip 20 is indexed between each blanking operation through an increment equal in length to the length of a side S of triangle T. Since the strip 20 must be fed through the apparatus until the web of unused portions 88 is cut off at the line W, the spacing between the centers 100 of outline configurations 90 and the orientation of the outline configurations is chosen so that the web of unused portions 88 is maintained integral; i.e., essentially unbroken, to enable advancement of the unused portions 88 as a whole, in the form of a web, to the cutting blades 54 and 64 at line W.

Thus, the invention provides a method of making toothed lock washers from sheet material wherein the lock washer bodies are blanked from the sheet material with adjacent outline configurations of the lock washers in close proximity within the sheet material, whereby the unused portions of sheet material between the outline configurations is minimized and sheet material is conserved.

It is to be understood that the above detailed description of an embodiment of the invention is provided by way of example only. Various details of design and construction may be modified without departing from the true spirit and scope of the invention, as set forth in the appended claims.

I claim:

1. In a method of making toothed lock washers from sheet material, each washer having a generally annular body portion including a center and a plurality of teeth projecting radially to an overall radius, said teeth being spaced circumferentially essentially equidistant from one another and twisted relative to the body portion to provide locking edges spaced axially from at least one surface of the body portion, the circumferential width of the spaces between adjacent teeth being at least as great as the circumferential width of the teeth themselves, the steps of:

blanking, from the sheet, a plurality of washer bodies, each leaving in the sheet an outline configuration which includes a number of radially projecting portions spaced circumferentially essentially equidistant from one another and corresponding to said teeth, with the circumferential spaces between the radially projecting portions having a circumferential width corresponding to the circumferential width of the spaces between adjacent teeth, said number of radially projecting portions being an odd whole number multiple of three;

simultaneous with, and as a result of, said blanking, positioning the washer body outline configurations relative to one another in the sheet such that three adjacent washer body outline configurations are located with the centers of the outline configurations positioned essentially at the vertices of an equilateral triangle and are oriented relative to one another such that a radially projecting portion of one of said outline configurations is aligned with a circumferential space between adjacent projecting portions of another of said outline configurations generally along a side of the equilateral triangle with the length of each side of the equilateral triangle being shorter than the sum of the overall radii of two of said three outline configurations such that each radially projecting portion which is aligned with a circumferential space along a side of the equilateral triangle enters into that circumferential space, whereby the outline configurations are nested in the sheet and the area of unused portions of the sheet between adjacent outline configurations is reduced to a minimum while the unused portions of the sheet are maintained in an integral web; and twisting the radially projecting portions of each blanked washer body to establish the locking edges.

2. The invention of claim 1 wherein the outline configurations are located along longitudinal lines in the sheet and the sheet includes a plurality of such longitudinal lines.

3. The invention of claim 1 wherein the radially projecting portions of each blanked washer body are twisted simultaneous with the blanking step.

4. The invention of claim 1 wherein the sheet is in the form of an elongate continuous strip of material and the strip is indexed through a predetermined increment after each blanking step in preparation for a subsequent blanking step, the length of the increment being equal to the length of the side of the equilateral triangle.

5. The invention of claim 1 wherein the odd whole number multiple of three is nine.

* * * * *